US010240355B2

(12) United States Patent
Coles et al.

(10) Patent No.: US 10,240,355 B2
(45) Date of Patent: Mar. 26, 2019

(54) OBJECT BINDING

(71) Applicant: CONSTRUCTION TOOLS PC AB, Kalmar (SE)

(72) Inventors: Ian David Coles, West Sussex (GB); Graham Frank Barnes, Surrey (GB); Paul Anthony Goater, West Sussex (GB); Matthew John Wilson, Daventry (GB); Roger Frank Duckworth, Whittlebury (GB)

(73) Assignee: Construction Tools PC AB, Kalmar (SE)

( * ) Notice: Subject to any disclaimer, the term of this patent is extended or adjusted under 35 U.S.C. 154(b) by 0 days.

(21) Appl. No.: 15/423,354

(22) Filed: Feb. 2, 2017

(65) Prior Publication Data

US 2017/0145704 A1 May 25, 2017

Related U.S. Application Data

(62) Division of application No. 12/089,896, filed as application No. PCT/GB2006/003749 on Oct. 9, 2006, now Pat. No. 9,593,496.

(30) Foreign Application Priority Data

| | | |
|---|---|---|
| Oct. 10, 2005 | (GB) | 0520523.2 |
| Oct. 14, 2005 | (GB) | 0520934.1 |
| Dec. 20, 2005 | (GB) | 0525885.0 |

(51) Int. Cl.
*E04G 21/12* (2006.01)
*B65B 13/28* (2006.01)

(52) U.S. Cl.
CPC ..... *E04G 21/123* (2013.01); *B65B 13/285* (2013.01); *E04G 21/122* (2013.01)

(58) Field of Classification Search
CPC ..... E04G 21/123; E04G 21/122; B21F 15/00; B65B 13/285
See application file for complete search history.

(56) References Cited

U.S. PATENT DOCUMENTS

| | | | |
|---|---|---|---|
| 1,809,566 | A | 6/1931 | Ekern |
| 2,919,894 | A | 1/1960 | Hepler |

(Continued)

FOREIGN PATENT DOCUMENTS

| | | |
|---|---|---|
| CH | 648085 | 2/1985 |
| CN | 1531497 A | 9/2004 |

(Continued)

OTHER PUBLICATIONS

Machine translation of DE 3419596A1, Runkel, translated on Jan. 7, 2017, pp. 1-10.*

(Continued)

*Primary Examiner* — Teresa M Ekiert
(74) *Attorney, Agent, or Firm* — Knobbe, Martens, Olson & Bear, LLP

(57) ABSTRACT

An apparatus for tying a wire 46; 52 around one or more objects such as concrete reinforcing bars 2 is disclosed. It comprises means for passing the wire 46; 52 in a loop around the bars and a rotatable head 4 for twisting the ends of the loop together. The head 4 has at least one gripping means such as a variable force clutch 32 for gripping the wire, the gripping means being adapted to provide a variable gripping force so as to apply a predetermined tension to the wire during at least a first phase of twisting.
Also disclosed is pre-feeding the wire between tying operations; conditioning the surface of the wire; and using the electrical conductivity of the reinforcing bars to verify that the bars are present before tying.

13 Claims, 16 Drawing Sheets

(56) References Cited

U.S. PATENT DOCUMENTS

| | | | | |
|---|---|---|---|---|
| 3,028,885 | A | | 4/1962 | Leslie et al. |
| 3,632,959 | A | | 1/1972 | Nelson et al. |
| 3,718,798 | A | | 2/1973 | Randolph et al. |
| 4,362,192 | A | | 12/1982 | Furlong et al. |
| 4,508,030 | A | | 4/1985 | Grenon |
| 4,542,773 | A | | 9/1985 | Lafon |
| 4,655,264 | A | | 4/1987 | Dilley |
| 4,953,598 | A | | 9/1990 | McCavey |
| 5,004,020 | A | | 4/1991 | Meinershagen |
| 5,311,721 | A | | 5/1994 | Urchaga |
| 5,323,816 | A | | 6/1994 | Hoyaukin |
| 5,368,278 | A | * | 11/1994 | Kurmis ..... B65B 13/027 100/32 |
| 5,678,613 | A | | 10/1997 | Murayama et al. |
| 5,778,945 | A | | 7/1998 | Crowther |
| 5,826,629 | A | | 10/1998 | West |
| 5,947,166 | A | | 9/1999 | Doyle et al. |
| 6,041,833 | A | | 3/2000 | Suric |
| 7,051,650 | B2 | | 5/2006 | Kusakari et al. |
| 7,140,400 | B2 | | 11/2006 | Yokochi et al. |
| 7,143,792 | B2 | | 12/2006 | Ishikawa et al. |
| 7,275,567 | B2 | | 10/2007 | Ishii et al. |
| 8,844,434 | B2 | | 9/2014 | Barnes et al. |
| 2003/0010225 | A1 | | 1/2003 | Pearson et al. |
| 2004/0244866 | A1 | | 12/2004 | Ishikawa et al. |
| 2006/0157139 | A1 | | 7/2006 | Hoyaukin |
| 2011/0155277 | A1 | | 2/2011 | Coles et al. |
| 2012/0055577 | A1 | | 3/2012 | Barnes et al. |
| 2012/0111206 | A1 | | 5/2012 | Barnes |
| 2012/0132088 | A1 | | 5/2012 | Barnes et al. |

FOREIGN PATENT DOCUMENTS

| | | | | |
|---|---|---|---|---|
| CN | 2652552 | Y | 11/2004 | |
| DE | 1511828 | | 9/1966 | |
| DE | 2804300 | A1 | 8/1979 | |
| DE | 3419596 | A1 * | 12/1984 | ..... E04G 21/122 |
| DE | 198 06 995 | A1 | 9/1999 | |
| EP | 0 757 143 | A1 | 7/1996 | |
| EP | 1 415 917 | A | 6/2004 | |
| EP | 1 557 359 | A1 | 7/2005 | |
| FR | 1576602 | | 6/1969 | |
| FR | 2552364 | A1 | 3/1985 | |
| GB | 1 533 508 | | 5/1977 | |
| JP | 2000-064617 | A | 2/2000 | |
| WO | WO 93/02816 | A | 2/1993 | |
| WO | WO 2004/083559 | A1 | 9/2004 | |
| WO | WO 2007/042785 | A1 | 4/2007 | |

OTHER PUBLICATIONS

Office Action dated Mar. 23, 2017 in corresponding CN Application No. 201510673195.0.

Office Action dated Feb. 13, 2017 in corresponding IN Application No. 1819/KOLNP/2008.

Chinese Office Action for Application No. 201510673195.0, dated Jun. 14, 2018 in 14 pages ( with English translation).

* cited by examiner

OBJECT BINDING

CROSS REFERENCE TO RELATED APPLICATIONS

This application is a divisional of U.S. application Ser. No. 12/089,896, filed on Mar. 14, 2011 as the U.S. National Phase of PCT International Application Number PCT/GB2006/003749, filed on Oct. 9, 2006. This application claims the benefit and priority to that international application, as well as the benefit and priority to United Kingdom Patent Application No. GB 0520523.2 filed on Oct. 10, 2005; and United Kingdom Patent Application No. GB 0520934.1 filed on Oct. 14, 2005; and United Kingdom Patent Application No. GB 0525885.0 filed on Dec. 20, 2005, the international application also claiming priority to these UK applications. The disclosures of the above-referenced application are hereby expressly incorporated by reference in its entirety.

FIELD OF THE INVENTION

This invention relates to apparatus and methods for binding together objects using wire to tie them to each other. It relates particularly, although not exclusively, to binding together reinforcing bars which provide reinforcement to concrete structures.

BACKGROUND OF THE INVENTION

When building large concrete structures e.g. walls, floors, columns etc. in buildings, grids of reinforcing bars must typically be laid out and bound together on site before the concrete is poured over them. The reinforcing bars are laid out in a rectangular grid of horizontal and vertical bars. At selected intersections between horizontal and vertical bars, they are tied together using a loop of stiff wire which is passed diagonally under the intersection and the two ends of which are twisted together above the intersection in order to tie the two bars together. Traditionally this has been carried out manually although it is difficult, laborious and repetitive.

There are available on the market some powered machines to carry out this task. Another machine is described in WO 2004/083559. Reference should be made to this document for full details although briefly the machine comprises a pair of claws which pass down either side of an intersection between two bars so that a wire can be passed (by means of a guide shuttle) across the gap between the tips of the claws and thereafter drawn up around the intersection and twisted together by means of a rotating spindle.

An improvement demonstrated by the machine disclosed in WO 2004/083559 over prior arrangements is that the wire is allowed to be drawn out of the spindle during twisting by allowing some slippage against the grip on the wire. This helps to prevent the wire breaking under excess tension.

Although the improvements described in WO 2004/083559 should be useful, the Applicant has appreciated that further improvement is possible. One problem which the Applicant has noticed is that it is common practice when in actual use on building sites to use the jaws of machines of the type described generally above, to knock flat the twisted ends of the wire once the twisting operation has been completed in order to prevent things snagging on the twisted wire which may have sharp ends. However, such machines are not designed for this purpose it has been observed that repeated knocks to the lower jaws from such use and other rough handling can quickly cause them to become distorted or misaligned. Since the jaws are essential for guiding the wire in the correct path, any such misalignment or distortion can prevent the machine operating properly.

Another potential problem identified by the Applicant is that achieving the proper tension in the twisted wire relies on the bending strength of the wire and friction exhibited between the wire and the gripping parts of the machine. However, if the surface of the wire or the interior gripping surface inside the machine should be contaminated with oil or grease, or indeed even if the machine is used in damp conditions, the degree of friction actually exhibited may be less than intended leading to a lower tension in the twisted wire and therefore a more loosely tied connection.

The Applicant has further appreciated that an inherent problem with tying machines of the kind described is that since there must always be a region through which the wire passes which is essentially open, to allow the wire to pass around the bars, there might conceivably be an increased risk of injury to an operator or someone else if the wire tying action were initiated accidentally, for example when a part of the body was in the tying zone.

It is an object of the present invention to provide at least some improvement on the aforementioned arrangements.

SUMMARY OF THE INVENTION

When viewed from a first aspect the invention provides an apparatus for tying two or more objects together comprising wire issuing and wire receiving means arranged to pass a wire imparted with an arcuate set in a loop around the objects from the issuing means to the receiving means.

Thus it will be seen by those skilled in the art that in accordance with the invention rather than the wire being guided around the objects to be tied with a pair of jaws, the apparatus relies on an arcuate set imparted to the wire to guide it around the objects to the receiving means. This is clearly advantageous as the alignment of the wire does not rely on the positions of jaws. The apparatus can therefore be made less prone to damage that prevents it working properly.

The apparatus in accordance with the invention could be jaw-less and when viewed from a further aspect the invention provides an apparatus for tying two or more objects together comprising jaw-less wire issuing and wire receiving means arranged to pass a wire imparted with an arcuate set in an unguided loop around the objects from the issuing means to the receiving means. By jaw-less is meant that no part of it will project below the lowermost member being tied and indeed no part of it need project below either or any of the members to be tied together, so the whole operation can be carried out from above.

If no jaws are provided the apparatus can be made extremely robustly. However it is not essential for it to be jaw-less. The Applicant has found that in some situations it is necessary or desirable to increase the force transmitted from the wire issuing means through the wire, for example to overcame resistance at the receiving means. As will be appreciated if the free end of the wire encounters too great a resistance, rather than advancing round, the wire loop grows in diameter.

In accordance with some preferred embodiments of the first aspect of the invention, wire containment means are provided for restricting the growth in diameter of the wire loop. Such means allow a significantly greater force to be transmitted through the wire loop and thus make it easier to overcome any resistance encountered, e.g. at the receiving means.

The wire containment means could simply be an extension of the shroud on one or both sides, a frame, or any other suitable structure for restricting enlargement of the loop. The wire containment means could even comprise one or more jaws. It will be appreciated however that in this example the jaw(s) are not relied upon to guide the wire accurately to the receiving means, the arcuate set achieves that, but rather to restrict enlargement of the loop. The construction of the jaw(s) may therefore be much simpler and the accurate positioning thereof is not essential in order to guide the wire. The benefits discussed above therefore still apply.

The arcuate set which is imparted to the wire could simply be that which results from it being coiled around a spool for storage. However, this is possibly unreliable as spools may be of different sizes, wound to different tensions or unevenly; and the diameter of the set will reduce as the spool is consumed. Preferably, therefore, the apparatus comprises means for imparting the required arcuate set. This could comprise, for example, pinch rollers and/or a suitably curved guide surface or channel.

The set applied to the wire is preferably substantially planar so that the free end of the wire tends to return towards the point from which it was issued; although in preferred embodiments the wire receiving means is arranged to guide the free end of the wire so as to have a slight lateral offset. This means that the issuing and receiving means may be laterally offset from one another which allows the device as a whole to be kept as compact as possible.

The wire receiving means preferably comprises a funneled surface to guide the free end of the wire into means for gripping it. The range over which the free end of the wire may strike the receiving means and still be properly guided to the gripping means will of course depend on the accuracy with which the wire loop is guided through the air by its pre-given set. Preferably the receiving surface is adapted to accommodate the free end of the wire landing within 10 cm of the gripping means in any direction, more preferably within 5 cm and more preferably within 1 cm.

In some preferred embodiments the wire receiving means is adapted to detect when the free end of the wire has been received. Preferably the apparatus comprises means for determining if the wire has not been received correctly by the receiving means. For example such a determination could be made if the receiving means has not received the wire after a predetermined time; or after a predetermined number of revolutions of a feed mechanism; or any combination of these. Preferably the apparatus is configured to stop the wire feed if such a determination is made. Preferably it is also configured to release the wire as failure for the wire to be received normally indicates that it has become jammed or fouled. This could include cutting the wire to facilitate its removal.

Preferably the apparatus comprises means for sensing the presence of a legitimate object to be tied in the zone through which the wire will pass. This enhances the safety of the apparatus by helping to ensure that the tying is only commenced in the correct circumstances. The sensing means could issue an alert if an appropriate object is not in the correct vicinity but preferably it simply prevents the tying action being initiated through a suitable controller.

The sensing means could be configured to sense particular sizes or shapes corresponding to legitimate objects to be tied but preferably it senses the presence of an appropriate material for the object. For example, in the preferred embodiment in which the apparatus is adapted to tie concrete reinforcing bars together, the objects to be tied will be metal, more specifically steel. Preferably therefore the sensing means is arranged to sense the presence of metal, e.g. steel objects. In some embodiments the sensing means is arranged to sense the thermal, or preferably electrical, conductivity of the object. In other embodiments the sensing means is arranged to sense the presence of a material having a degree of ferromagnetism such as a steel bar. Any suitable magnetic sensor may be employed but preferably the sensing means in such embodiments comprises a Hall effect device. Detecting the presence of an object having the correct properties is advantageous insofar as it can discriminate a metal bar from e.g. a finger which simple contact sensors (e.g. micro-switches) cannot.

Such arrangements are novel and inventive in their own right and thus when viewed from a second aspect the invention provides apparatus for tying a wire around one or more objects, said apparatus comprising sensing means adapted to detect electrical conductivity of an object for determining the presence of an electrically conductive object to be tied prior to tying being initiated.

When viewed from another aspect the invention provides apparatus for tying a wire around one or more objects, said apparatus comprising ferromagnetic sensing means for determining the presence of an object to be tied prior to tying being initiated.

The Applicants have also devised further improvements over the device described in WO 2004/083559. In accordance with preferred embodiments of the invention there is provided means for twisting the wire under tension said means being adapted to grip the wire with a variable gripping force so as in use to apply a substantially predetermined tension to the wire during at least a first tying phase. Thus in such embodiments the amount of grip is controlled to ensure that a desired amount of tension is applied to the wire during twisting. This helps to overcome the problems encountered in use of prior art devices in which the amount of grip could be influenced by uncontrolled external factors.

Any suitable means could be employed to give the described functionality but preferably the gripping means comprises one or more variable force clutch mechanisms. Preferably the apparatus comprises means for providing feedback of the amount of tension in the wire. This could, for example, be measured by monitoring current through a motor driving twisting means. Preferably however the or each clutch mechanism comprises a member resiliently biased onto the wire and shaped to increase the clamping force on the wire as the wire is drawn past it.

The tension applied could be substantially constant throughout the twisting or could be varied, e.g. to reduce it after the first one or few turns. The Applicant has recognised that the most effective binding turns are the first one or two and therefore that a much lower tension may be used for subsequent turns without affecting the binding tightness. After the first few turns it has been recognised that subsequent twisting essentially simply tidies up the ends of the wire.

Such arrangements as set out above are novel and inventive in their own right and thus when viewed from a further aspect the invention provides apparatus for tying a wire around one or more objects comprising means for passing said wire in a loop around the objects and means for twisting the ends of said loop together, said twisting means comprising at least one gripping means for gripping the wire, said gripping means being adapted to provide a variable gripping force so as to apply a predetermined tension to the wire during at least a first phase of twisting.

It will be seen that the arrangements set out above are an improvement on the arrangement in WO 2004/083559 where the degree of grip was not controlled. However, they share the principle of the wire being drawn out from the twisting mechanism by overcoming a resistance. However, in another arrangement devised by the Applicant, the ends of the wire are gripped sufficiently tightly to prevent the ends of the wire being pulled out during twisting but wherein the twisting mechanism is arranged to be drawn towards the object(s) being tied against a resilient bias force during twisting. This has the same effect of limiting the tension in the wire so that it is less prone to breaking under excess tension. Preferably said resilient biasing force is provided by a sprung housing, stand or frame which engages the object(s) being tied. Alternatively, the compressible portion of the apparatus may be provided elsewhere, e.g. between a frame or housing and the parts of the apparatus mounting the twisting mechanism.

This is also novel and inventive in its own right and when viewed from a further aspect the invention provides apparatus for tying a wire around one or more objects comprising means for passing said wire in a loop around the objects and means for twisting the ends of said loop together, said twisting means comprising at least one gripping means for gripping the wire so that the wire does not slip therethrough, the apparatus comprising means for applying a biasing force between the twisting means and an object being tied such that as said wire is twisted the twisting means is drawn towards the object against said biasing force.

The Applicant has appreciated that the friction between the surface of the wire and the rollers, clutches and the like which interact with it is an important parameter. Furthermore it recognises that this can be affected by external factors. The previously mentioned variable force gripping means may be sufficient to accommodate the normally encountered range of friction coefficients. However in accordance with a further preferred feature of the invention, conditioning means are provided for altering the frictional properties of the surface of the wire. By being able to alter the frictional properties of the wire, the performance and reliability of the apparatus can be improved.

Such a feature is novel and inventive in its own right and thus when viewed from a further aspect the invention provides an apparatus for tying two or more objects together by means of a wire comprising wire issuing and wire receiving means, wherein the apparatus comprises means for conditioning the surface of the wire for altering the frictional properties thereof.

The conditioning means could be arranged to reduce the friction presented by the wire—e.g. by smoothing, cleaning and/or lubricating the wire. Preferably however the conditioning means is arranged to increase the friction of the surface. This could be done by e.g. by coating the wire with a suitable material but preferably it is done by altering the texture of the surface—i.e. roughening it. In a preferred example the conditioning means comprises means for serrating the surface. Preferably the conditioning means comprises a suitable set of rollers, one or more of which have a surface adapted to impart the desired texture. The conditioning means could be independent of other mechanisms in the apparatus. Preferably however the conditioning means comprises a feed and/or bending roller which also performs another function in the operation of the apparatus.

The surface conditioning could be applied around the whole circumference but in some preferred embodiments it is applied to part of the circumference only. This would allow it to be effective in some parts of the machine but not others depending on their circumferential orientation relative to the wire. Of course different conditioning could be applied to different parts of the circumference.

In accordance with all aspects it is normally necessary for the wire to be cut from a spool before twisting commences. This could be effected by a dedicated cutter. Preferably however the apparatus is configured to shear the wire as the twisting mechanism begins to turn. This is simpler and cheaper to manufacture than a dedicated cutter and associated controlling electronics. In some embodiments it could be arranged that more current is supplied to a motor at start-up to facilitate this.

The Applicant has recognised the difficulties associated with dealing with the sharp ends that remain after the wire has been twisted. As explained previously, embodiments of the invention can be made much more robust than prior art machines and so will withstand better being used to knock over the wire after twisting. However it is still not desirable for the wire to require knocking over and in accordance with a further preferred feature the apparatus comprises a guiding surface arranged to deflect the wire as it is being twisted so that the ends of the wire finish pointing at least partially in the direction of the objects being tied, i.e. downwardly where the apparatus is used in the normal configuration vertically, above the objects. It has been found that in accordance with this feature there is no need to knock over the twisted portion of wire in order satisfactorily to reduce the risk of snagging—having the ends of the wire pointing downwardly can be sufficient for this.

Such a feature is also novel and inventive in its own right and thus when viewed from a further aspect the invention provides an apparatus for tying two or more objects together comprising means for passing a wire around the objects to form a loop and means for twisting the sides of the loop together, the device further comprising a guiding surface arranged to deflect the wire as it is being twisted so that the ends of the wire finish pointing at least partially in the direction of the objects being tied.

The guiding surface is preferably formed as a depression on part of the twisting means. The surface is therefore preferably rotationally symmetric and smoothly rounded to prevent catching. In preferred embodiments the guiding surface is part-spherical.

At least preferred embodiments of the apparatus of the invention comprise a rotatable head arranged to rotate in order to twist the ends of the wire together. It could be arranged that the rotatable head comprises the guide guides the wire to its maximum diameter—i.e. that which is necessary to form a loop which passes around the intersecting reinforcing bars. Such an arrangement might be constructionally simple. However the Applicant has realised that the resulting diameter of the rotating head and hence the overall size of the lower part of the apparatus can be undesirably large in this case. In fact it has appreciated that because in accordance with preferred embodiments the ends of the wire are drawn together prior to rotation, the diameter of the head need only accommodate this smaller separation. Accordingly it is preferred that the rotatable head is smaller in diameter than the initial loop diameter. Where, as is preferred, the wire issuing means is provided on the rotatable head this means that the wire will move from the point at which it issues from the head as it is drawn in. Conveniently a slot is provided on the head to facilitate this.

In preferred embodiments of the invention parking means are provided for returning the head to a predetermined 'parking' position or one of a plurality of predetermined parking positions. This is valuable as it ensures that the head is in the correct place for the next tying operation. Preferably the parking means is arranged to prevent the head from moving from said parking position in at least one direction. The parking means could comprise indexing or other position-determining means arranged to determine when the head is in a or the parking position so as to stop the motor and possibly engage a lock. For example a solenoid-operated latch or pin could be employed.

In at least some preferred embodiments of all aspects of the invention the parking means referred to above comprises a ratchet arrangement arranged to prevent rotation of the head in one direction beyond one or more predetermined points. Preferably the ratchet arrangement comprises a resiliently biased pawl acting on the head. The head could for example be provided with a suitable notch, stop or detent. Of course the pawl and ratchet surface could be reversed. Such ratchet arrangements are simple and reliable to implement and provide an automatic, physical, locking location of the head in a or the parking position when the head is rotated in the opposite direction to the normal twisting direction, in order to park it.

In WO 2004/083559 the wire is cut where it crosses from the stationary part of the apparatus into the rotatable head in order to allow the head to rotate. A fresh length of wire is fed into the rotatable head when the next tying operation is commenced. This sequence is perfectly logical. However the Applicant has appreciated that by altering this operation of the apparatus may be made more efficient. Preferably therefore the apparatus is arranged to pre-feed a length of wire beyond the cutting means at the end of a tying operation. By pre-feeding the wire at the end of the cutting operation, the subsequent tying operation can be carried out more quickly. Effectively this feature utilises the 'dead time' between tying operations which is required for the operator to move the machine to the next intersection requiring a tie. It has been found that in one example this can reduce the time for each tying operation by about 10 to 20 percent which is significant, particularly when multiplied across large numbers of operations.

This feature is novel and inventive in its own right and thus when viewed from a yet further aspect the invention provides an apparatus for tying a wire around one or more objects in a tying operation the apparatus comprising means for cutting a length of wire from a spool; and said apparatus being arranged to pre-feed a further length of wire beyond said cutting means after said tying operation and before a subsequent tying operation is commenced.

The amount of wire that is pre-fed will depend to an extent on the construction of the apparatus. It is normally expected however that the wire will be pre-fed to an extent that it is not exposed from the apparatus. Of course it is necessary to ensure that the pre-fed wire does not interfere with locating the apparatus at the next reinforcing bar intersection.

The precise point in the cycle at which the pre-feed occurs is not critical as long as it happens at some stage between completion of one tying operation and commencement of the next. Preferably it occurs after the or a rotatable head has been locked to prevent rotation.

BRIEF DESCRIPTION OF THE DRAWINGS

Certain preferred embodiments of the invention will now be described, by way of example only, with reference to the accompanying drawings in which.

DETAILED DESCRIPTION OF THE PREFERRED EMBODIMENTS

Figure 1A:
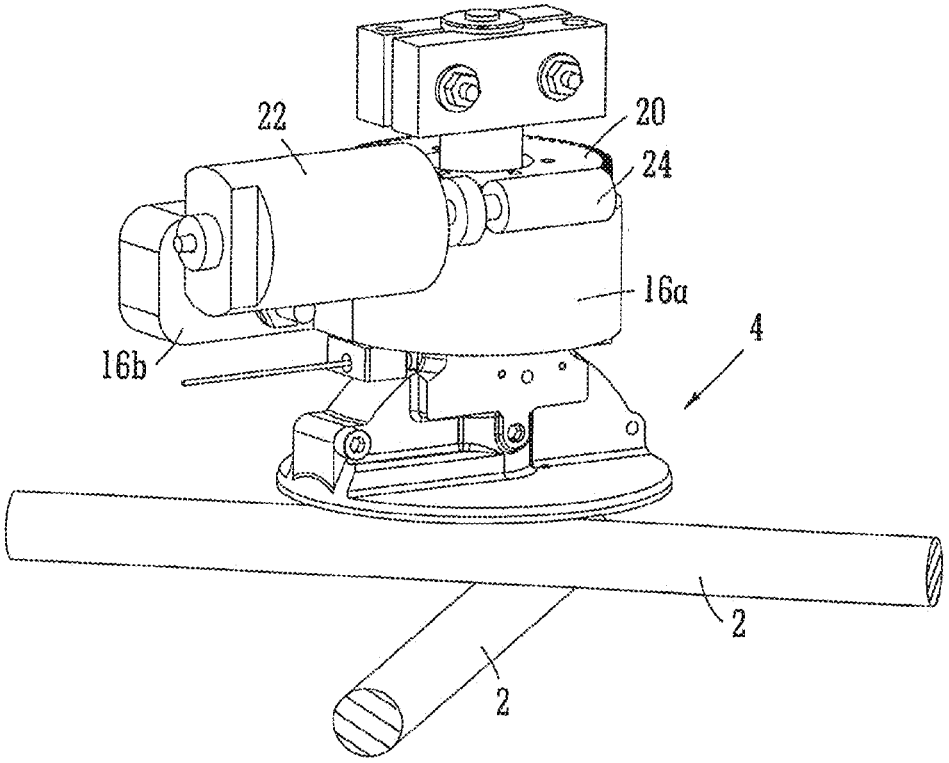
FIG. 1*a* is a perspective view of an apparatus embodying the invention, with out housings removed, above a pair of crossed bars prior to a tying operation being initiated.
Figure 1B:
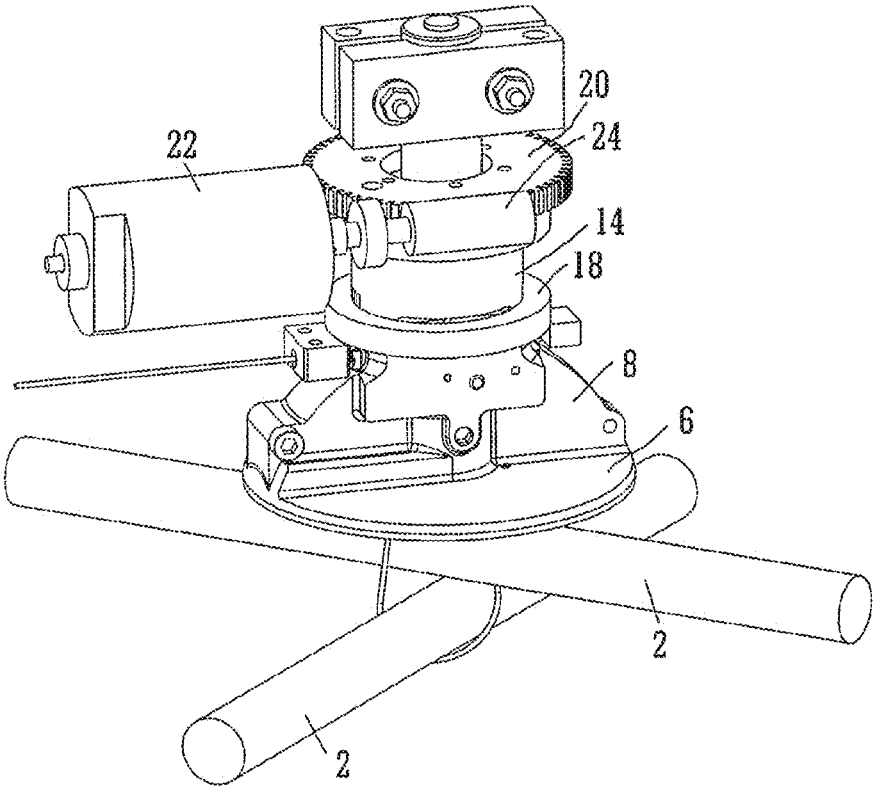
FIG. 1*b* is a view similar to FIG. 1*a* with the main mounting bracket removed.
Figure 2:
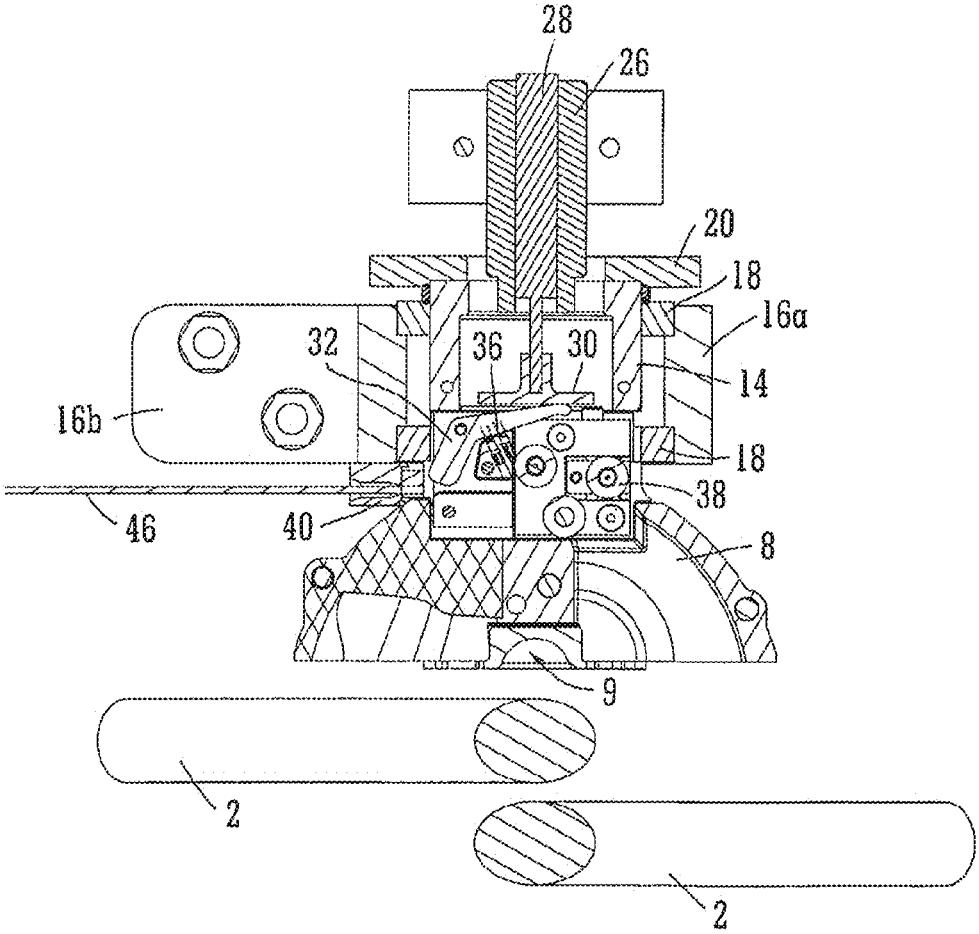
FIG. 2 sectional view through the apparatus shown in FIG. 1.

Referring first to FIGS. 1*a*, 1*b* and 2 there is shown two perspective views and a sectional view of part of an apparatus in accordance with the invention with certain parts such as the housing, handle, battery, controls, lower shroud and wire spool removed for clarity. The apparatus is shown situated over a junction where two steel bars 2 cross over each other at right angles. The steel bars 2 are intended to form a rectangular grid to be embedded in a concrete structure in order to reinforce it. Although not shown, a domed shroud is provided around the lower end of the apparatus and has two part-circular depressions so that the apparatus can securely rest on the upper of the two bars 2 without slipping off.

Figure 3:
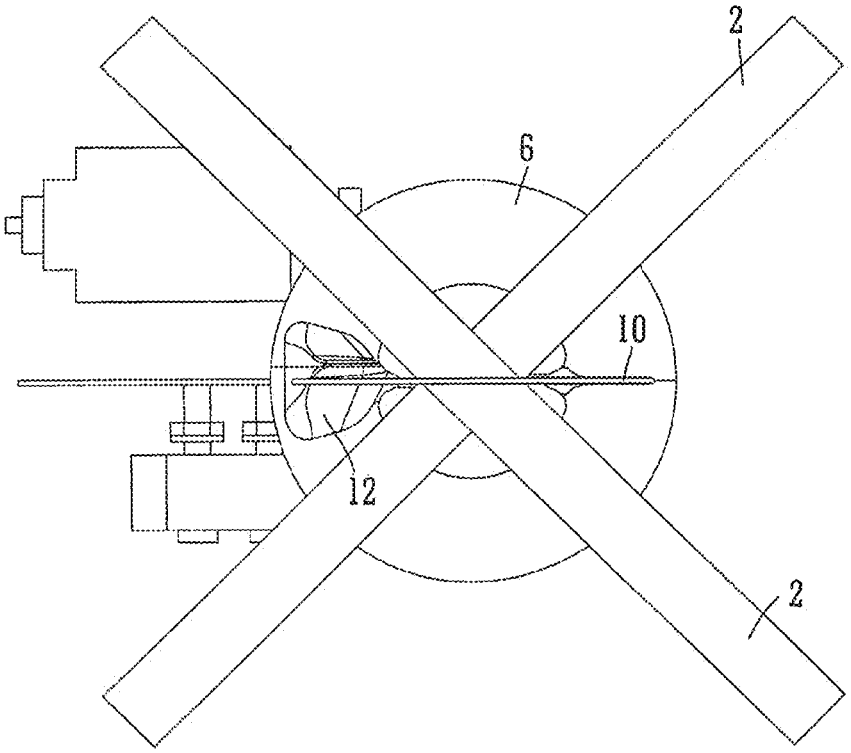
FIG. 3 is a view of the apparatus from beneath.

Sitting in use above the uppermost bar 2 is the rotary head of the apparatus 4. This includes a horizontal circular base plate 6 extending up from which is a channel 8 which is approximately semi-circular in vertical section and of approximately constant width in the orthogonal direction. In the centre of base plate 6 is a part-spherical depression 9. The underneath of the base plate 6 is shown in FIG. 3 from which it will be seen that on one side there is a narrow slot 10 corresponding to one end of the semi-circular channel and on the other side of the plate 6 corresponding to the other end of the channel is a funnel region 12.

Returning to FIGS. 1*a*, 1*b* and 2, attached to the semi-circular channel 8 is the upper cylindrical portion of the head 14 which is rotatably mounted in the cylindrical portion 16*a* of a bracket member mounted to the housing (not shown) by a flange portion 16*b* (omitted from FIG. 1*b*). The upper head portion is supported by two rotary bearings 18. A toothed gear wheel, 20 is provided fixed at the top of the head to allow it to be driven by a motor 22 via a worm gear.

Extending through the gear wheel 20 into the open upper end of the head 4 is a solenoid assembly comprising a cylindrical outer tube 26 housing the coil and an inner plunger 28 which is able to slide vertically relative to the coil 26. At the bottom end of the plunger 28 is an actuating disc 30, the purpose of which will be explained later.

The internal construction of the head 4 will now be described. On the left hand side as seen from FIG. 2, there may be seen a pivotally mounted angled clutch lever 32. A pair of compression springs 36 act on the longer, upper arm of the lever 32 so as to bias the lever in an anti-clockwise direction in which the shorter, lower arm is pressed downwardly. Of course any number of springs might be used. To the right of the clutch lever 32 are a series of roller wheels 38*a*,38*b*,38*c* the purpose of which will be explained below. A similar clutch lever is provided displaced approximately 180 degrees around the head. This is not therefore visible in the sectional view.

To the left of the upper head portion 14 connected to the main bracket flange portion 16*b* is a wire feed inlet guide 40 which receives the free end of wire 46 which has been unwound from the spool (not shown).

Figure 4:
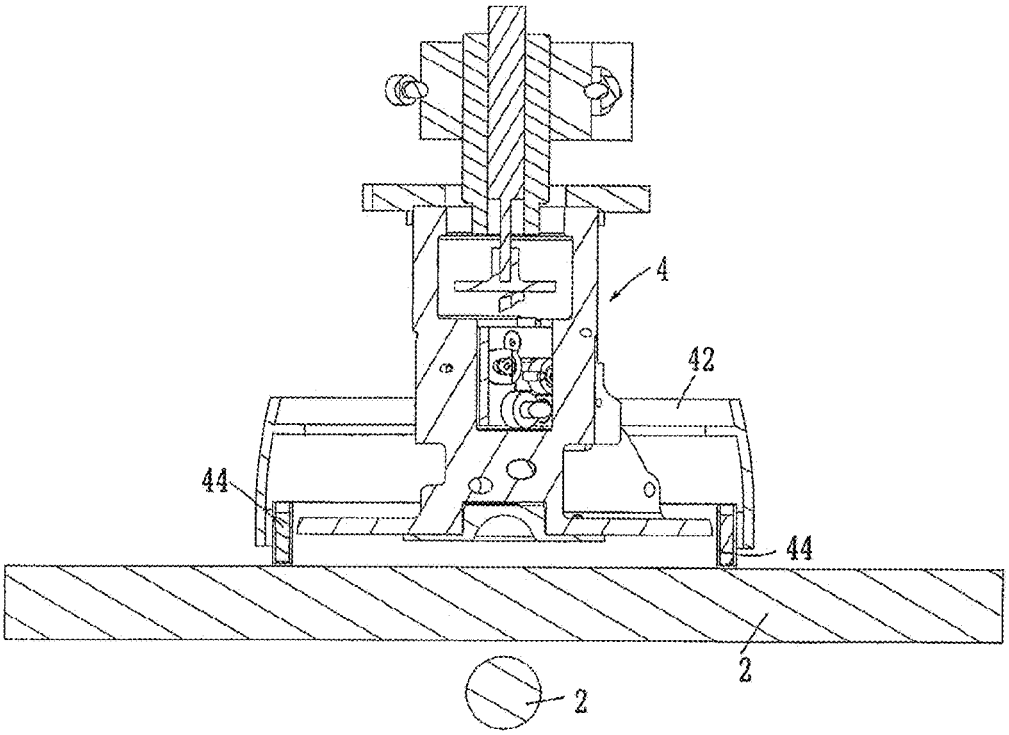
FIG. 4 is a partly schematic sectional view of the apparatus showing the lower shroud.
Figure 5:
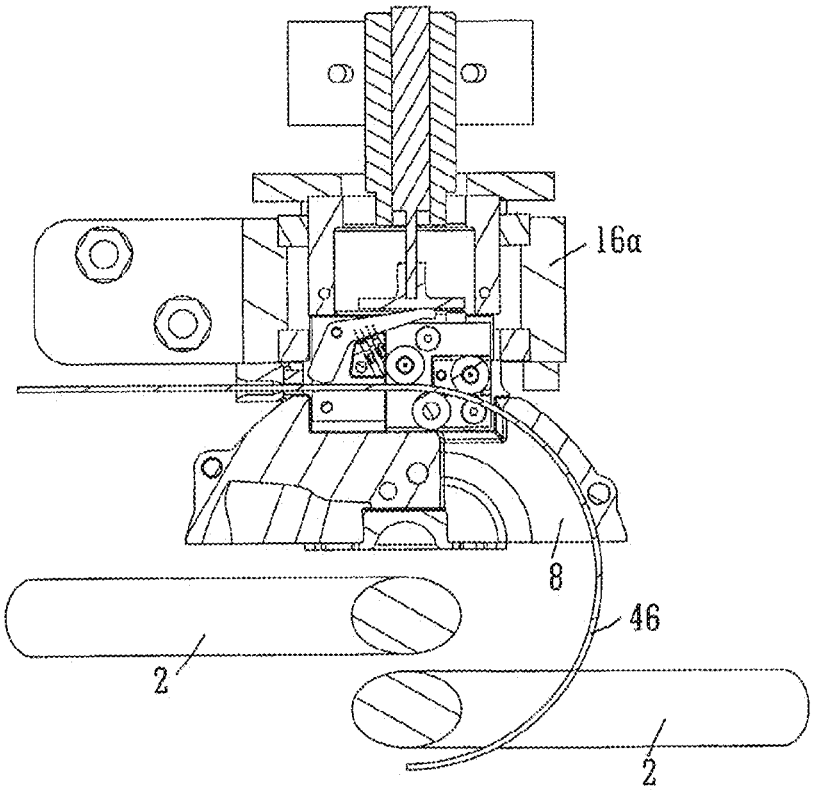
FIG. 5 is a sectional view similar to FIG. 2 showing the apparatus part-way through a tying operation.

FIG. 4 is a partly-schematic view of the apparatus in which the lower shroud 42 is shown. At two opposed points just inside the edge of the shroud 42 are disposed a pair of Hall effect sensors 44 which protrude slightly from the shroud. However they could equally be flush or slightly recessed. A further two sensors are provided at 90 degrees to those shown so that whichever of the four possible rotational positions the apparatus is brought down onto a steel reinforcing bar 2, two of the Hall sensors will give a detectable electronic signal indicating the ferromagnetic nature of the steel.

In an alternative embodiment (not shown) a pair of electrodes (one of which could be formed by part of the body or housing of the machine) are arranged to contact the reinforcing bar when it is properly positioned, thereby completing an electrical circuit through the bar.

Operation of the apparatus will now be described. The apparatus is first brought down onto the uppermost of a pair of steel reinforcing bars 2 which are crossed at right angles. When the shroud 42 is properly resting on the bar 2, the presence of the steel will be sensed by the two Hall effect sensors 44 which will allow the tying operation to be commenced. If the operator should attempt to commence the tying operation before both Hall effect sensors 44 sense the presence of the steel bar 2, a warning light such as an LED is illuminated and further operation of the apparatus is prevented.

In the alternative embodiment referred to above the sensing is carried out by detecting the completion of an electrical circuit though the bar. This shares the advantage that the sensing mechanism cannot be fooled by part of an operator's body such as a finger, or clothing etc.

Once the steel bar 2 is properly sensed, the operator may commence the tying operation. The first part of this operation is to energise the solenoid coil 26 which pushes the plunger member 28 downwardly. This causes the actuating member 30 at the end of the plunger to be pressed downwardly onto the upper arms of the clutch levers 32 to press them down against the respective compression springs 36 and therefore raise the shorter, lower arms. This is the position which is shown in FIG. 2.

Thereafter the main motor 22 is, if necessary, operated just long enough to rotate head 4 via the worm drive and gear wheel 24, 20 so that a channel for receiving the wire 46 is in correct alignment with the wire feed inlet guide 40. This is called the "park" position. The correct alignment may be detected simply by respective contacts provided on upper head portion 14 and the cylindrical housing 16*a* or wire inlet guide 40, although of course there are many other possibilities for this position detection.

Once the head 4 is in the "park" position, a separate motor (not shown) is operated to drive a wire feed roller (also not shown) that acts on the wire 46 to feed it from the spool through the wire inlet guide 40 and into the aligned channel in the upper head portion 14. The wire is fed in horizontally and encounters the first of the passive rollers 38*a*. The first roller 38*a* causes the wire to bend downwardly slightly so that it passes between the second and third rollers 38*b*, 38*c*.

The relative positions of the three passive rollers 38*a*, 38*b*,38*c* is such that when the wire 46 emerges from them it is bent so as to have an arcuate set. As the wire 46 continues to be driven by the wire feed roller, it encounters and is guided by the inner surface of the semi-circular channel 8.

When the wire 46 emerges from the channel 8, its arcuate set causes it to continue to describe an approximately circular arc, now unguided in free space, around the two reinforcing bars. This is shown in FIG. 4. As the wire 46 continues to be driven, the free end will eventually strike the mouth of the funnel region 12 in the bottom of the base plate 6 and therefore be guided back into the semi-circular channel 8. However it is not guided back precisely diametrically opposite where it was issued from but rather slightly laterally offset therefrom. This allows the receiving means in the form of a further clutch lever (not shown) to be located next to the first clutch lever 32 which enables the apparatus to be kept relatively compact.

It will be appreciated that since the wire 46 describes a free, unguided circular path there is no need for any of the apparatus such as jaws to project below the reinforcing bars 2 to pass the wire around beneath them.

As the free end of the wire re-enters the semi-circular channel 8, it encounters the second clutch lever. This can be detected by sensing a slight displacement of the lever or by a separate sensor such as a micro switch, Hall effect sensor or other position detection means.

Once the free end of the wire 46 is detected, the motor feeding the wire is stopped and therefore the wire does not advance any further. At this point the solenoid coil 26 is then de-energised which causes the plunger 28 to be retracted by a spring (not shown) which releases the two clutch levers 32 so that their respective compression springs 36 act to press their lower arms against the two ends of the wire loop and therefore hold the wire 46 in place.

Figure 6A:
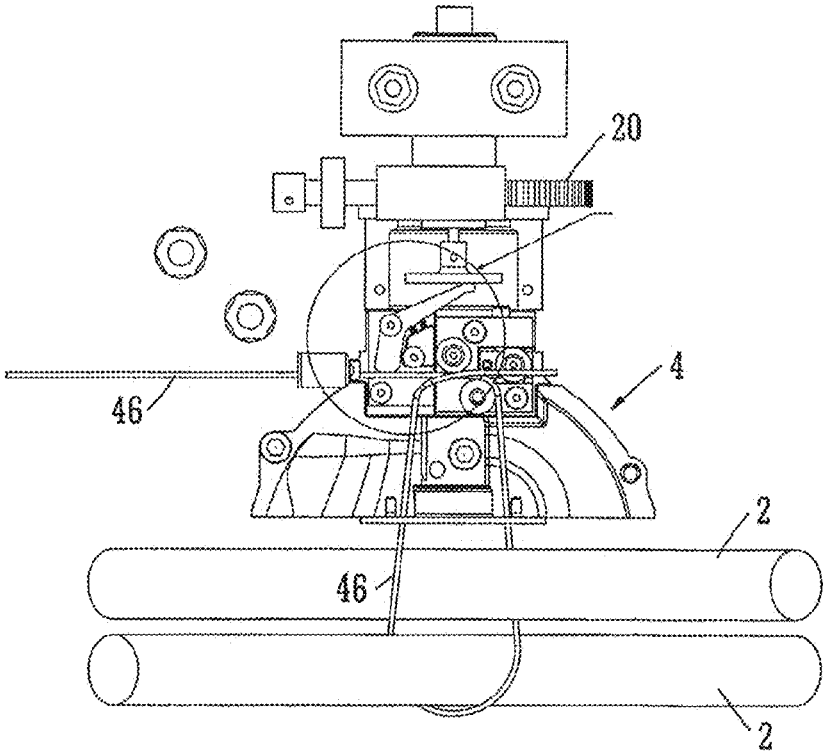
FIG. 6*a* is another sectional view showing the wire tensioned prior to twisting.
Figure 6B:
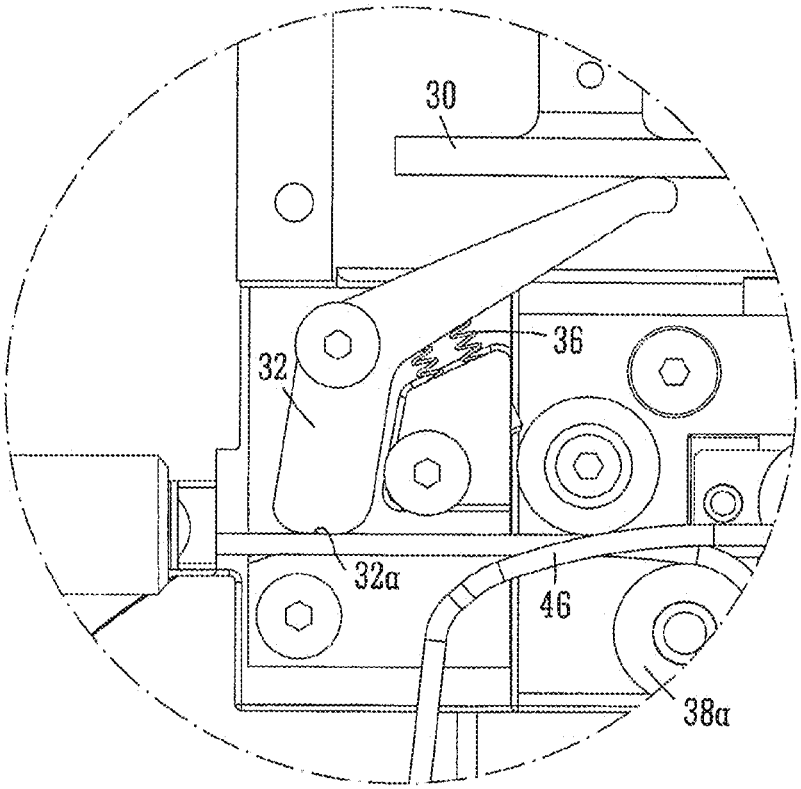
FIG. 6*b* is an enlargement of the circled part of FIG. 6*a;*

The wire feed motor is driven in reverse in order to apply tension to the wire loop which draws the wire in around the reinforcing bars 2. This may be seen in FIG. 6*a*. FIG. 6*b* shows detail of the clutch lever 32 on the feed side clamping the end of the wire 46. A similar arrangement clamps the other end of the wire as explained above. When the wire 46 is fully tensioned it will be seen from FIG. 6*a* that the two ends of the loop are pulled up almost vertically from their initial circular profile.

As the head 4 tries to start rotating at the beginning of the twisting operation the torque supplied by the motor 22 is sufficient to shear the wire at the point where it crosses from the inlet guide 40 to the upper head portion 14 without the need for it to be cut. If necessary an initial surge current (e.g. boosted by a charge stored in a capacitor) can be supplied to the motor 22 to deliver an initial spike in torque but this is not essential. With the wire thus broken, the head 4 begins to twist the sides of the loop together above the reinforcing bars 2.

The first one or two turns of the head are the most important in ensuring a tight binding. As will be appreciated, these initial twists are carried out under tension and therefore a very tight binding is achieved.

As twisting continues, each successive turn is less important for providing a tight binding. As twisting continues the tension in the wire will increase. However, the shape of the rounded ends 32*a* of the clutch levers that bear against the ends of the wire mean that as the wire is pulled passed it, it will tend to be pulled slightly anti-clockwise (looking at the lever shown in FIG. 6*a*) and so increase the friction on the wire. This arrangement acts as an effective self-regulating mechanism to ensure that the wire can be drawn out by a measured amount. Since the area of mutual contact between the clutch lever 32 and the wire 46 is relatively small, effectively a point contact, the resistance force is less dependent on the co-efficient of friction than in prior art arrangements.

When a satisfactorily twisted binding is achieved, which could be after just one turn or even less than a complete turn, the free ends of the wire simply need to be twisted together to reduce the risk of snagging they pose. This is achieved by releasing the ends of the wire by once again energising the solenoid 26 to push the plunger 28 down and so disengage the lower faces 32*a* of the clutch levers from the wire 46. The remaining turns of the head are therefore carried out with the ends of the wire no longer clamped. The friction between the wire and the channel inside the head and the fact that the wire is required to bend as it is drawn out is sufficient to allow the rotary module to twist the ends. As sides of the loop are twisted together a stiff twisted section extends upwardly towards the base plate 6 and is accommodated in the spherical depression 9 which deflects the twisted section down again. This means that when the ends of the wire emerge from the bottom of the head 4, they will be pointing generally downwardly, i.e. towards the bars 2 rather than upwardly. The risk of snagging is therefore significantly reduced to the extent that the twisted section does not need to be manually knocked over to more the ends of the wire out of the way.

Once tying is completed the solenoid 26 is de-energised, allowing the plunger 28 to retract and therefore releasing the clutch levers 32. By this time the ends of the wire will have passed through so the clutch levers no longer bear on the wire. Rotation of the head 4 is stopped except to return it to the initial "park" position. A signal is then given to the operator that the tying operation has been successfully completed. This may, for example, involve illuminating a green LED or giving a beep.

If during the initial phase of operation where the wire 46 is passed around the bars 2 the free end is not sensed on the receiving side, then after a predetermined time or a predetermined number of revolutions of the wire feed motor, the apparatus determines that a malfunction has taken place and so stops the wire feed motor and then carries out the wire cutting operation described above by applying a surge current to the main motor 22. After this the head 4 is returned to the "park" position and a further solenoid is energised to project a pin from the cylindrical bracket housing 16*a* into the upper head portion 14 to prevent further rotation until the fault has been rectified and this rotation lock has been manually reset by a user. A warning signal is given to a user e.g. by illuminating a red LED. At the end of this operation the main solenoid 26 is de-activated again.

It will be seen from the foregoing description that a particularly advantageous apparatus for binding together two bars by tying a loop of wire around them is provided. In particular, since the wire initially executes a large, approximately circular, path around the two bars and is then drawn up under tension into a tight loop, the advantage is obtained of not requiring jaws or the like projecting below the two bars in order to guide the wire, whilst at the same time giving the advantage that vertical pre-tension is applied before twisting takes place which results in a tight binding.

Figure 7:
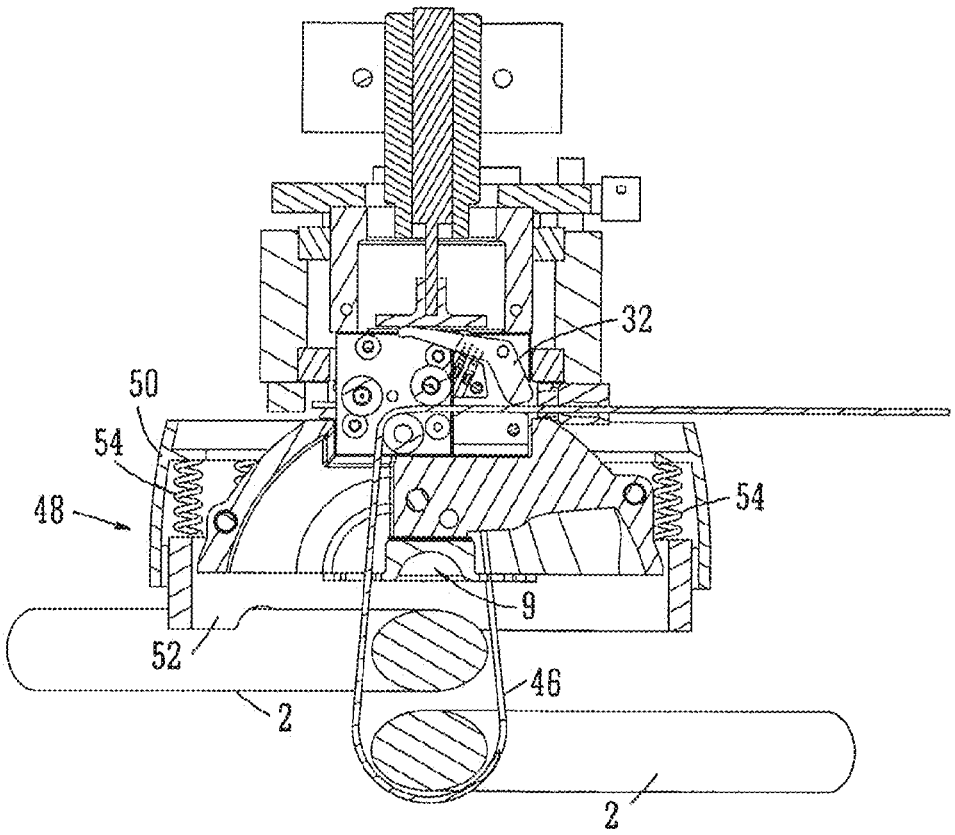
FIG. 7 is a sectional view of a second embodiment of the invention which has a sprung shroud.

A second embodiment of the invention is shown in FIG. 7. In this embodiment the apparatus is broadly the same as the previously described embodiment except that it has a different lower shroud 48. In particular, the shroud 48 comprises a fixed portion 50 and a moveable sprung portion 52 mounted to the fixed portion by a series of circumferentially spaced compression springs 54. As is shown in FIG. 7, the lower sprung portion of the shroud 52 sits on the steel reinforcing bar 2 in use of the device. Furthermore, it may be seen that the combined force of the compression springs 54 is sufficient to bear not only the weight of the apparatus, but the initial tension applied to the wire 46 before twisting is commenced which is the stage depicted in FIG. 7.

However, as the wire is twisted through the first one or few turns, the increasing tension in the wire 46 pulls the apparatus down towards the reinforcing bar 2 against the force of the springs 54. This helps to limit the tension in the wire to prevent breakage. This embodiment is shown with the previously described clutch lever arrangements, although it will be appreciated that in view of the sprung shroud it may not be necessary to allow the wire to slip past the clutches. A different clamping mechanism might therefore be used.

When the wire is released by the clutch levers 32 or other clamp mechanism, the restoring force of the springs 54 pushes the apparatus back up and helps to draw the wire out of the device.

Once the ends of the wire have been twisted together, there will inevitably be two short end portions which are not fully twisted and therefore stick out and still prevent a risk of snagging. It is therefore practice to bend the twisted part of the wire down so that the sharp ends of the wire no longer stick up but rather are angled downwards. Although this should be done manually, if an operator decides in practice to use the end of the device, it will be the circular base plate 6 or shroud 42, 48 which strikes the wire. These are both robust and firmly fixed to the body of the apparatus and so will not be damaged by this abuse. Moreover neither part performs a critical function in the operation of the apparatus.

Figure 8:
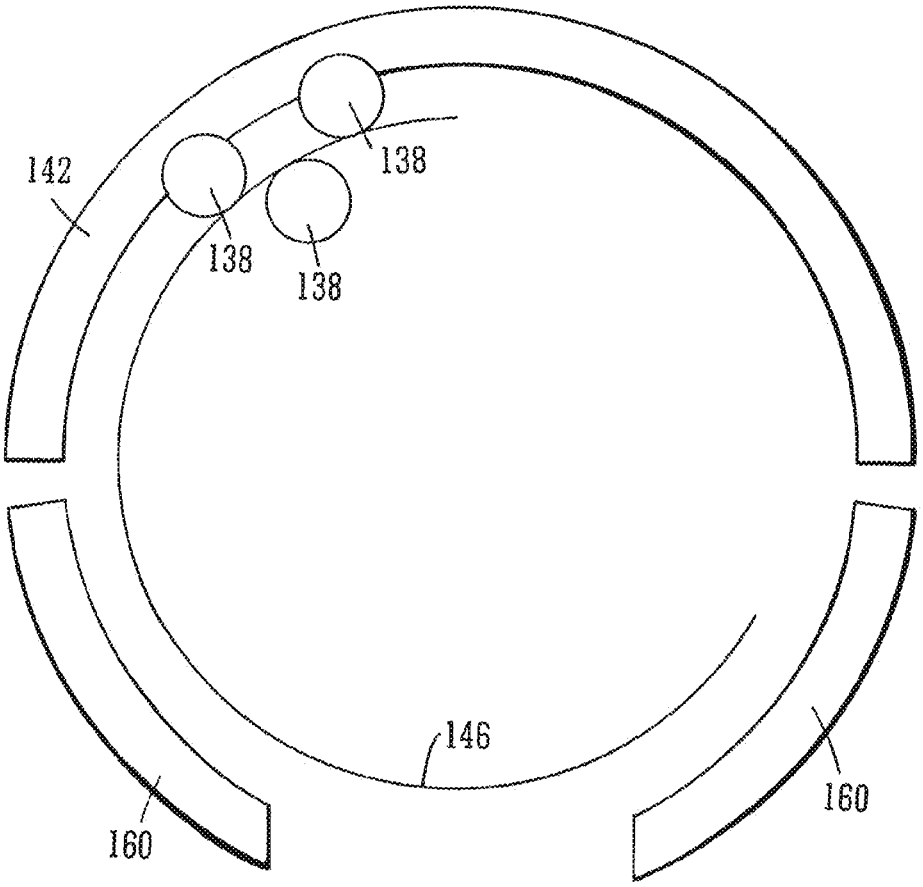
FIG. 8 is a schematic view of the lower part of a further apparatus in accordance with some of the inventions set out herein.

A further embodiment is shown in FIG. 8. In this embodiment a set of rollers 138 impart an arcuate set to the wire 146 as it leaves the head. Wire containment means in the form of a pair of curved support members 160 extend down from a shroud 142 around the head so as to straddle the junction between the two bars being tied (not shown). As the wire 146 advances around towards the receiving means it is guided by its arcuate set and does not even touch the support members 160. However if when the end of the wire 146 encounters resistance at the receiving means, rather than advancing further the diameter of the loop will increase as more wire is paid out by the head wire-issuing mechanism. After a short time though the wire loop grows into the support members which constrain it, preventing further growth. This again allows the loop to transmit the paying-out force to the end in order to overcome the resistance at the receiving end.

It will be seen that the shape and exact location of the support members 160 is not critical and they may be made more robust and tolerant of damage than delicate jaws required to guide the wire.

Figure 11:
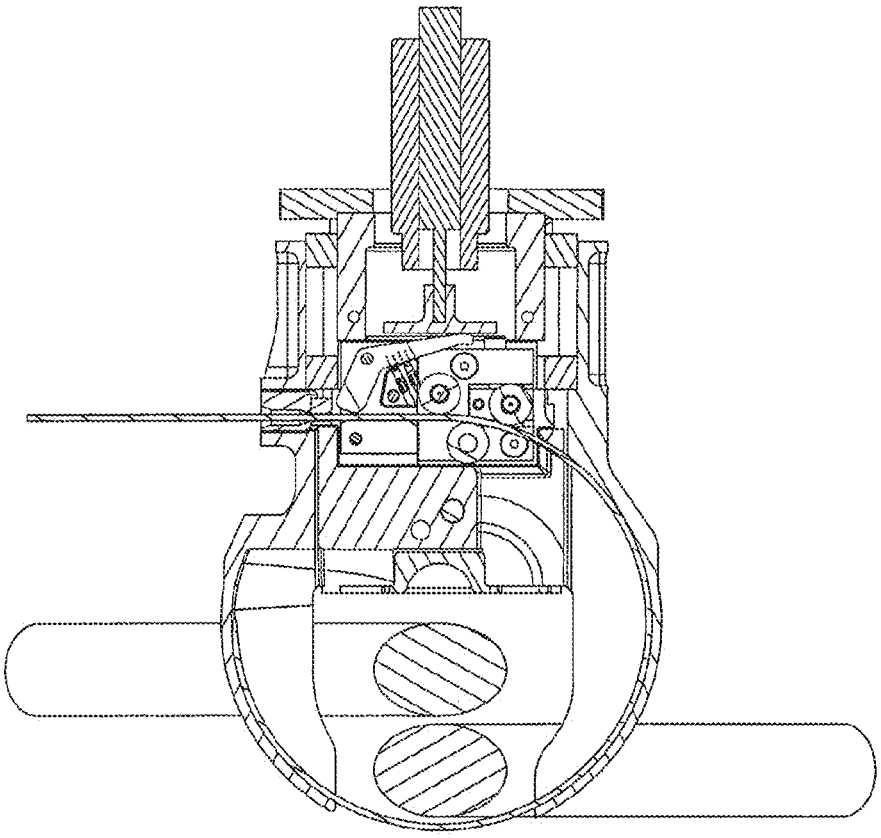
FIG. 11 is a view similar to FIG. 9 during the tying operation.
Figure 12:
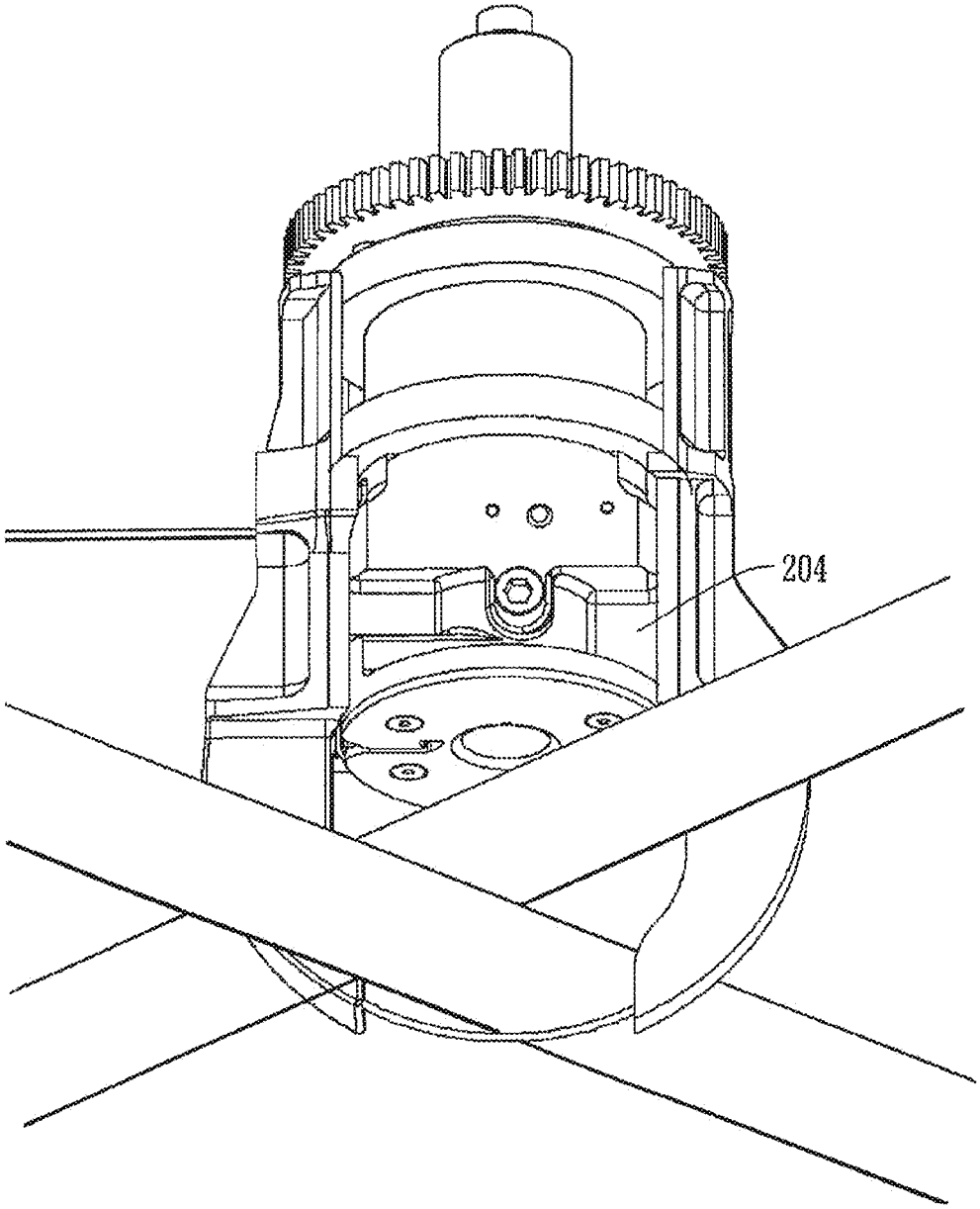
FIG. 12 is a perspective view corresponding to FIG. 11.
Figure 13:
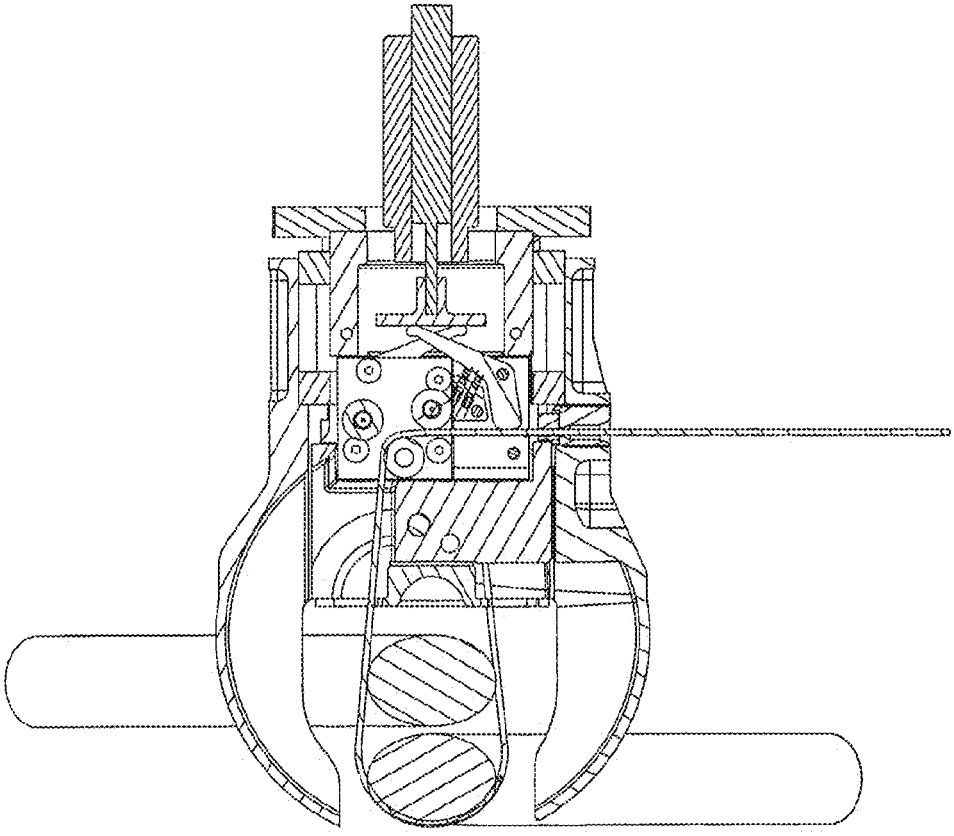
FIG. 13 is a cross-sectional view of the apparatus showing the wire immediately prior to twisting.

A further embodiment of the invention is shown in FIGS. 9 to 13. This embodiment shares many characteristics with those previously described and the common features will not be described again in detail. An important difference exhibited by the embodiment of FIGS. 9 to 13 is that the rotatable head 204 is significantly smaller in diameter than in the previous embodiments. This can be seen by comparing the rotating head as shown in FIG. 12 with FIG. 1*b* which shows the rotating parts 6, 8, 14, 18, 20 of the first embodiment. In particular in FIG. 1*b* the base plate 6 and semi-circular channel 8 are both as wide as the loop of wire issued and rotate at this diameter. In the embodiment of FIGS. 9 to 13 the wire 46 is issued into one of the wire guides 260*a*, 260*b* which do not rotate; it is not guided out to its maximum diameter by the head. Thus rather than the rotating head having the diameter $D_1$ of the initial wire loop it has the much smaller diameter $D_2$. This allows the overall size of the machine including housing etc. (not shown here to be much smaller and lighter). It also reduces the torque required of the motor further enhancing the size and weight benefits.

The head 204 is open to the side in the region of the wire issuing means (rollers 238 etc.) but is closed off at the bottom by a tying plate 270. This is seen most clearly in the view from beneath of FIG. 10. The tying plate is circular with two generally radial slots 272, 274, which extend to the edge of the plate. Each slot has a 'double-back' portion 272*a*, 272*b* at its radially innermost end which helps to prevent the wire slipping back out along the slot once it has passed along it. At the centre of the plate is a domed depression 209 for turning down the ends of the wire as previously described.

Figure 9:
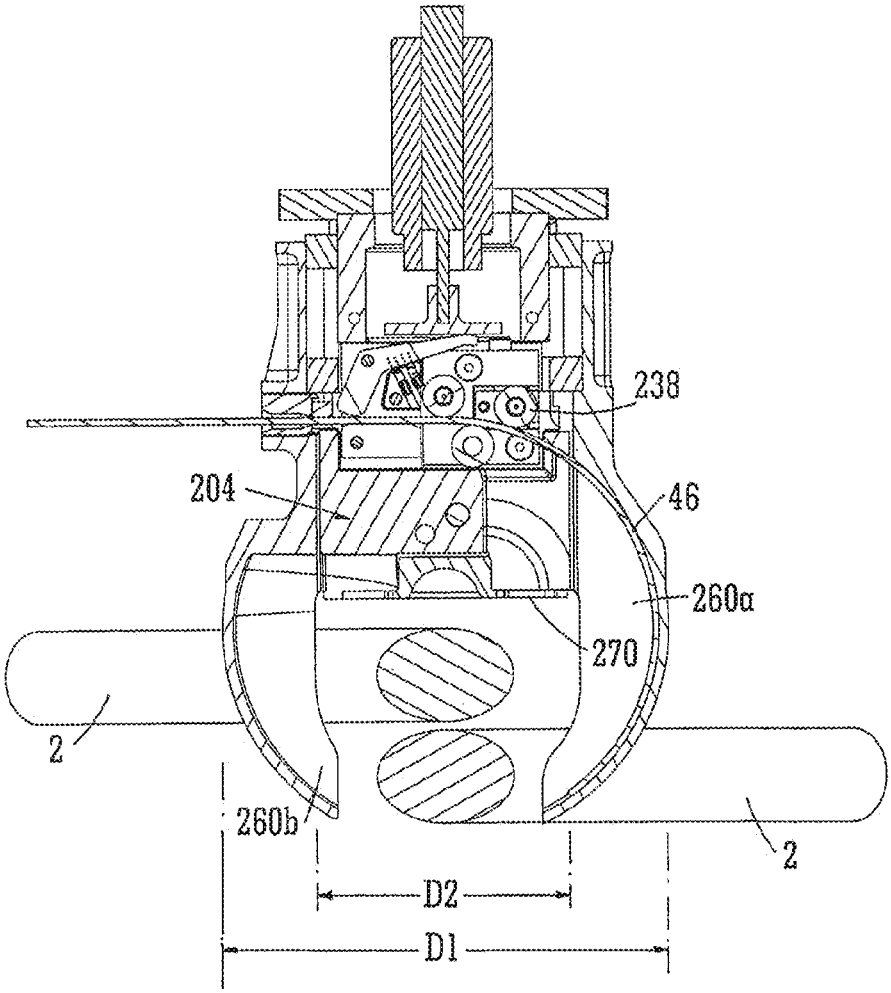
FIG. 9 is a cross-sectional view of a third embodiment of the invention prior to commencement of a tying operation.
Figure 10:
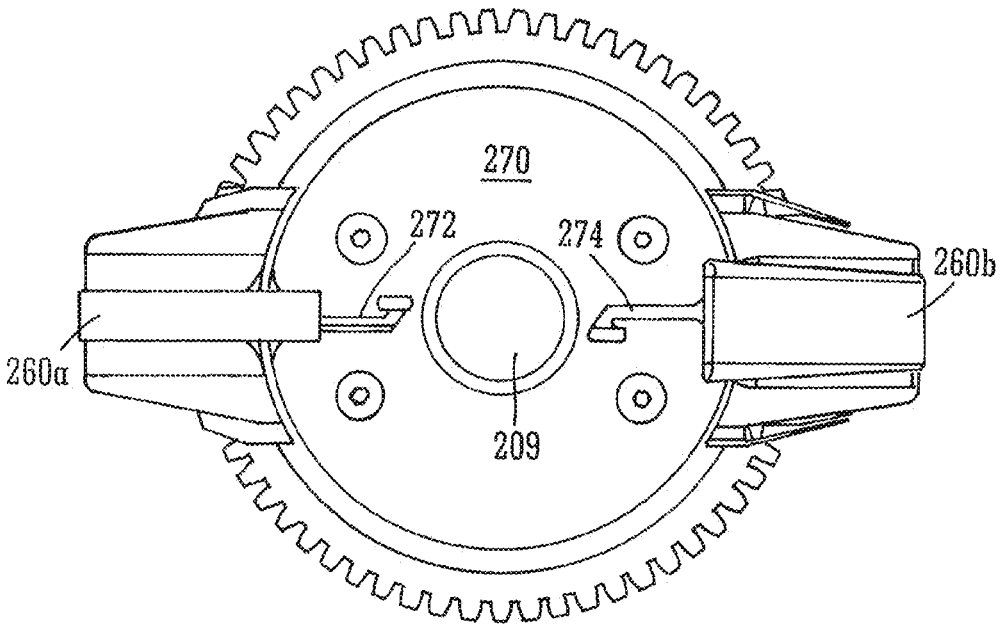
FIG. 10 is a bottom elevation of the apparatus of FIG. 9.

FIG. 9 shows the state of the machine immediately before a tying operation is commenced. In this state the guide 260*a* on the wire issuing side has a length of wire 46 already received in it. Thus when the tying operation is commenced the wire 46 begins immediately to cross the gap between the channels 260, under the reinforcing bars 2, and return back towards the receiving mechanism (clutch etc., not shown) on the other side of the head 204 to the issuing rollers 238). This is shown in FIGS. 11 and 12. During this phase of the tying operation the wire 46 does not pass through the tie plate 270.

As the wire advances it travels along the inside of the other guide member 260*b* until it is received and gripped by the receiving side rollers and clamped by the clutch member (also not shown) as previously described. However because the wire 46 starts at the bottom end of the guide member 260*a* rather than where it first enters the head 204 from the spool (not shown), it has less distance to travel and the loop is completed more quickly—in approximately two thirds the time. This makes the overall tying operation quicker which is advantageous in terms of efficiency.

As before if the end of the wire should not have been received after a predetermined time or number of revolutions of the feed motor the motor is stopped. This allows safe operator intervention without risking damage to the machine or the operator should the wire have become tangled. In the embodiment described herein the wire is first retracted back to the position shown in FIG. 9 (i.e. the pre-feed position). In other embodiments however it could simply be left where it is for the operator to deal with, e.g. by cutting it manually; or automatically cut to allow it to be released by the operator.

In this embodiment the wire travels around the inside surfaces of the guide members 260*a*, 260*b* and so in contrast to the containment channels 160, the guide members do provide some guiding function. However the arcuate set on the wire is still significant as it allows the wire to pass through the open volume between the issuing part of the head 204 and the top end of the guide member 260*a*. This in turn enables the reduction in diameter of the head discussed. The set on the wire also obviates any need to provide a shuttle or the like to guide the wire across the gap between the guides 260*a*, 260*b*.

Once the wire is clamped at the receiving end the feed mechanism is reversed as described before to pull the wire taut around the bars 2. This causes the wire 46 to pass into the slots 272, 274 on either side of the tie plate until it is caught in the double-back portions 272*a*, 274*a*. The head 204 including the tie plate 270 is then rotated to twist the wire exactly as in the previous embodiments. After the tying operation is completed however, and the head 204 has been returned to its 'park' position, the feed motor is operated once again just long enough for the wire 46 to advance to the end of the first guide member 260*a*, i.e. to reach the situation shown in FIG. 9. This can be carried out while the operator is moving the machine to the next tie site but reduces the time taken for the actual tying operation so allowing the overall work rate which can be achieved to increase.

Although not visible in the Figures, one of the wire feed rollers 238 does not have a smooth surface but rather has a circumferentially spaced series of teeth. By being of a harder material than the wire, this imparts the wire with a serrated surface texture which increases the grip which the receiving side clutch can apply to it. Since the serrated roller is disposed on one side of the wire only, only part of the circumference of the wire will be conditioned in this way. Of course many other types of conditioning could be applied e.g. smoothing or lubricating, or other sorts of roughening. Equally the conditioning could be applied at a different point in the machine or at several points.

Figure 14:
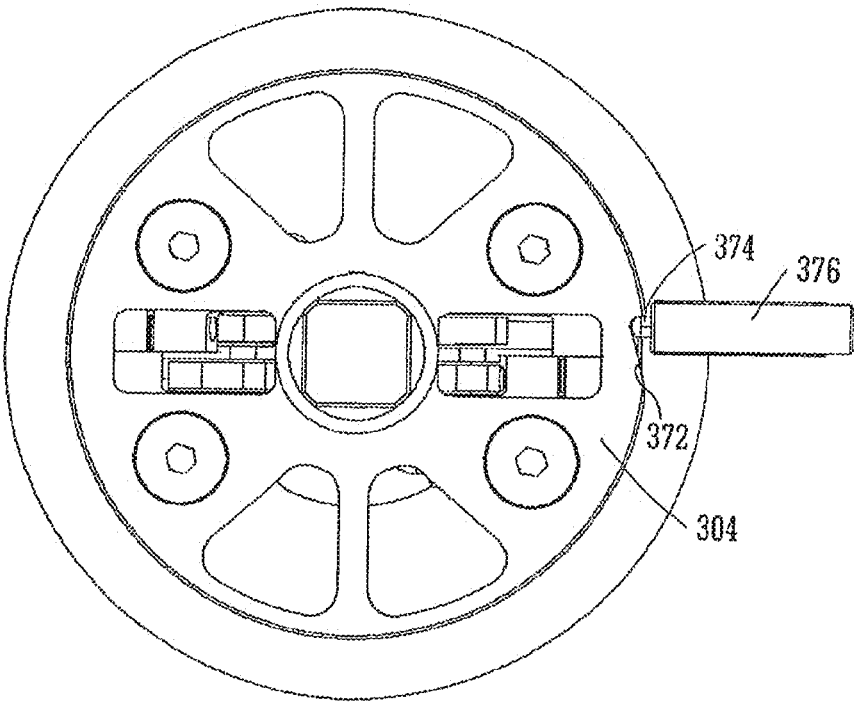
FIG. 14 is a partial sectional view of a further embodiment of the invention.

A feature of a yet further embodiment of the invention is shown in FIG. 14. In this embodiment the outer circumference of the rotary head 304 has an inclined notch 372 formed in it. A pin 374 is spring-mounted to a barrel 376 which is fixed to the body of the apparatus (not shown) and is arranged so as to be pressed into the notch 372 when they are rotationally aligned. When they are not aligned the pin 372 is forced back into the barrel 376 by the circumference of the head 304. This gives a ratchet arrangement in which the head 304 can rotate freely in an anti-clockwise direction (as viewed from FIG. 14) but cannot rotate in the clockwise direction beyond the point at which the pin 374 is aligned with the notch 372 in the head. The head can thus be rotated anti-clockwise to twist the wire as previously described; and then the rotation reversed to return the head to the park position shown in FIG. 14. Of course there could be more than one park position depending on the symmetry of the head, in which case there would be corresponding multiple notches (and/or pins). This ratchet arrangement has the advantage of being a simple and reliable way of parking the head.

It will be appreciated by those skilled in the art that only certain specific embodiments of the invention have been described and that many variations and modifications are possible within the scope of the invention. For example, it is not essential to employ the resiliently biased clutch mechanisms described but rather other variable force clamping mechanisms might be envisaged e.g. involving feedback of the tension in the wire; or indeed it may not be necessary to provide any such variable force mechanism.

Although the invention has been described in the context of tying a loop of wire around a crossed pair of steel concrete reinforcing bars, apparatus according to the invention may be used in other applications and for example it is not essential that two items are bound together, it may be that a wire is tied onto a single item. Equally, although Hall sensors have been described for detecting the presence of a bar prior to tying, many other ways of achieving this may be envisaged.

What is claimed is:

1. An apparatus for tying a wire around one or more objects comprising:

a wire feed roller for passing said wire in a loop around the one or more objects, and a rotating and gripping mechanism for twisting the ends of said wire together, said rotating and gripping mechanism comprising a rotatable head arranged to rotate in order to twist the ends of the wire together and at least one gripper for gripping the wire so that the wire does not slip therethrough, wherein the apparatus comprises a sprung housing, stand or frame for applying a resilient biasing force between the rotating and gripping mechanism and the one or more objects, wherein the sprung housing, stand or frame engages the one or more objects being tied such that the sprung housing, stand or frame applies the resilient biasing force between the rotating and gripping mechanism and the one or more objects while said wire is being twisted such that the rotating and gripping mechanism is drawn towards the one or more objects against said resilient biasing force.

2. The apparatus of claim 1, wherein the sprung housing, stand or frame comprises a fixed portion and a moveable portion.

3. The apparatus of claim 1, further comprising one or more rollers for altering the frictional properties of the surface of the wire and/or wherein the wire feed roller is arranged to alter the frictional properties of the surface of the wire.

4. The apparatus of claim 3, wherein said one or more rollers and/or the wire feed roller is adapted to increase the friction of the surface of the wire by altering the texture of the surface of the wire.

5. The apparatus of claim 4, wherein the one or more rollers and/or the wire feed roller comprises teeth for serrating the surface of the wire.

6. The apparatus of claim 3, wherein one or more of the one or more rollers and/or the wire feed roller has a surface adapted to impart a texture to the surface of the wire.

7. The apparatus of claim 3, wherein the one or more rollers comprises a bending roller.

8. The apparatus of claim 1, wherein the wire feed roller is provided on the rotatable head.

9. The apparatus of claim 1, wherein the rotatable head is arranged to return the rotatable head to a predetermined parking position or one of a plurality of predetermined parking positions.

10. The apparatus of claim 1, wherein the rotatable head is configured to apply a torque sufficient to shear the wire as the rotatable head begins to turn.

11. The apparatus of claim 1, wherein the apparatus further comprises a guiding surface arranged to deflect the wire as it is being twisted so that the ends of the wire finish pointing at least partially in a direction of the one or more objects being tied.

12. The apparatus of claim 1, wherein the apparatus further comprises a cutter for cutting the wire, wherein the wire feed roller is arranged to pre-feed a length of wire beyond the cutter at the end of a tying operation.

13. The apparatus of claim 1, wherein the wire feed roller and a wire receiving surface are arranged to pass the wire imparted with an arcuate set in the loop around the one or more objects from the wire feed roller to the wire receiving surface.

* * * * *